US008851882B2

(12) United States Patent
Hartwick et al.

(10) Patent No.: US 8,851,882 B2
(45) Date of Patent: Oct. 7, 2014

(54) SYSTEM AND APPARATUS FOR APPLYING AN ELECTRIC FIELD TO A COMBUSTION VOLUME

(75) Inventors: Thomas S. Hartwick, Snohomish, WA (US); David Goodson, Sequim, WA (US); Richard F. Rutkowski, Seattle, WA (US); Geoff Osler, Seattle, WA (US); Christopher A Wiklof, Everett, WA (US)

(73) Assignee: Clearsign Combustion Corporation, Seattle, WA (US)

( * ) Notice: Subject to any disclaimer, the term of this patent is extended or adjusted under 35 U.S.C. 154(b) by 1077 days.

(21) Appl. No.: 12/753,047

(22) Filed: Apr. 1, 2010

(65) Prior Publication Data

US 2011/0027734 A1 Feb. 3, 2011

Related U.S. Application Data

(60) Provisional application No. 61/166,550, filed on Apr. 3, 2009.

(51) Int. Cl.
*F23C 99/00* (2006.01)

(52) U.S. Cl.
CPC ..... *F23C 99/001* (2013.01)
USPC ..... 431/2; 431/253

(58) Field of Classification Search
USPC ..... 431/2, 253, 264, 354, 8; 700/274
See application file for complete search history.

(56) References Cited

U.S. PATENT DOCUMENTS

| | | | | |
|---|---|---|---|---|
| 1,153,182 | A | | 9/1915 | Schniewind |
| 2,604,936 | A | | 7/1952 | Kaehni et al. |
| 3,087,472 | A | | 4/1963 | Asakawa |
| 3,129,062 | A | * | 4/1964 | Ongkiehong et al. ..... 422/54 |
| 3,224,485 | A | | 12/1965 | Blomgren et al. |
| 3,306,338 | A | | 2/1967 | Wright et al. |
| 3,358,731 | A | | 12/1967 | Donnelly |
| 3,416,870 | A | | 12/1968 | Wright |
| 3,503,348 | A | | 3/1970 | Dvirka |
| 3,749,545 | A | | 7/1973 | Velkoff |
| 3,841,824 | A | | 10/1974 | Bethel |
| 3,869,362 | A | | 3/1975 | Machi et al. |
| 4,052,139 | A | | 10/1977 | Paillaud et al. |
| 4,091,779 | A | | 5/1978 | Saufferer et al. |
| 4,093,430 | A | | 6/1978 | Schwab et al. |

(Continued)

FOREIGN PATENT DOCUMENTS

EP 1139020 A1 * 10/2001 ..... F23C 11/00

OTHER PUBLICATIONS

James Lawton and Felix J. Weinberg. "Electrical Aspects of Combustion". Clarendon Press, Oxford. 1969.

(Continued)

*Primary Examiner* — Kenneth Rinehart
*Assistant Examiner* — Tavia Sullens
(74) *Attorney, Agent, or Firm* — Christopher A. Wiklof; Harold H. Bennett, II; Launchpad IP, Inc.

(57) ABSTRACT

According to an embodiment, combustion in a combustion volume is affected by at least two sequentially applied non-parallel electric fields. According to an embodiment, a combustion volume is equipped with at least three individually modulatable electrodes. According to an embodiment, an electric field application apparatus for a combustion volume includes a safety apparatus to reduce or eliminate danger.

15 Claims, 6 Drawing Sheets

(56) References Cited

U.S. PATENT DOCUMENTS

| | | | |
|---|---|---|---|
| 4,110,086 | A | 8/1978 | Schwab et al. |
| 4,111,636 | A | 9/1978 | Goldberg |
| 4,118,202 | A | 10/1978 | Scholes |
| 4,219,001 | A | 8/1980 | Kumagai et al. |
| 4,260,394 | A | 4/1981 | Rich |
| 4,304,096 | A | 12/1981 | Liu et al. |
| 4,340,024 | A | 7/1982 | Suzuki et al. |
| 4,439,980 | A | 4/1984 | Biblarz et al. |
| 4,649,260 | A | 3/1987 | Melis et al. |
| 4,675,029 | A | 6/1987 | Norman et al. |
| 4,903,616 | A | 2/1990 | Mavroudis |
| 4,987,839 | A | 1/1991 | Krigmont et al. |
| 5,702,244 | A | 12/1997 | Goodson et al. |
| 6,640,549 | B1 | 11/2003 | Wilson et al. |
| 6,736,133 | B2 | 5/2004 | Bachinski et al. |
| 6,742,340 | B2 | 6/2004 | Nearhoof, Sr. et al. |
| 6,918,755 | B1 | 7/2005 | Johnson et al. |
| 7,137,808 | B2 | 11/2006 | Branston et al. |
| 7,168,427 | B2 | 1/2007 | Bachinski et al. |
| 7,182,805 | B2 | 2/2007 | Reaves |
| 7,226,496 | B2 | 6/2007 | Ehlers |
| 7,226,497 | B2 | 6/2007 | Ashworth |
| 7,243,496 | B2 | 7/2007 | Pavlik et al. |
| 7,377,114 | B1 | 5/2008 | Pearce |
| 7,845,937 | B2 | 12/2010 | Hammer et al. |
| 8,082,725 | B2 | 12/2011 | Younsi et al. |
| 8,245,951 | B2 | 8/2012 | Fink et al. |
| 2005/0208442 | A1* | 9/2005 | Heiligers et al. ..... 431/75 |
| 2005/0208446 | A1* | 9/2005 | Jayne ..... 431/264 |
| 2006/0199122 | A1* | 9/2006 | Matteson et al. ..... 431/75 |
| 2007/0020567 | A1* | 1/2007 | Branston et al. ..... 431/8 |
| 2009/0064661 | A1* | 3/2009 | Younsi et al. ..... 60/204 |
| 2012/0317985 | A1 | 12/2012 | Hartwick et al. |
| 2013/0004902 | A1 | 1/2013 | Goodson et al. |
| 2013/0071794 | A1 | 3/2013 | Colannino et al. |

OTHER PUBLICATIONS

Altendrfner et al., "Electric Field Effects on Emissions and Flame Stability With Optimized Electric Field Geometry", Third European Combustion Meeting ECM 2007, p. 1-6.

William T. Brande; "The Bakerian Lecture: On Some New Electro-Chemical Phenomena", Phil. Trans. R. Soc. Lond. 1814 104, p. 51-61.

* cited by examiner

SYSTEM AND APPARATUS FOR APPLYING AN ELECTRIC FIELD TO A COMBUSTION VOLUME

CROSS-REFERENCE TO RELATED APPLICATIONS

The present application claims priority benefit under 35 USC §119(e) to U.S. Provisional Application Ser. No. 61/166,550; entitled "SYSTEM AND APPARATUS FOR APPLYING AN ELECTRIC FIELD TO A COMBUSTION VOLUME", invented by Thomas S. Hartwick, David Goodson, Richard Rutkowski, Geoff Osler and Christopher A. Wiklof, filed on Apr. 3, 2009, herewith on the date of filing, and which, to the extent not inconsistent with the disclosure herein, is incorporated by reference.

BACKGROUND

A time-varying electric field may be applied to a flame. The flame may respond by modifying its behavior, such as by increasing its rate of heat evolution.

SUMMARY

According to an embodiment, a system may provide a plurality of electric field axes configured to pass near or through a flame.

According to an embodiment, a plurality greater than two electrodes may selectively produce a plurality greater than two electric field axes through or near a flame. According to an embodiment, at least one of the selectable electric field axes may be at an angle and not parallel or antiparallel to at least one other of the selectable electric field axes.

According to an embodiment, a controller may sequentially select an electric field configuration in a combustion volume. A plurality greater than two electrode drivers may drive the sequential electric field configurations in the combustion volume. According to an embodiment, the controller may drive the sequential electric field configurations at a periodic rate.

According to an embodiment, a plurality of electric field modulation states may be produced sequentially at a periodic frequency equal to or greater than about 120 Hz. According to an embodiment, a plurality of electric field modulation states may be produced sequentially at a frequency of change equal to or greater than about 1 KHz.

According to an embodiment, a modulation frequency of electric field states in a combustion volume may be varied as a function of a fuel delivery rate, an airflow rate, a desired energy output rate, or other desired operational parameter.

According to an embodiment, an algorithm may be used to determine one or more characteristics of one or more sequences of electric field modulation states. The algorithm may be a function of input variables and/or detected variables. The input variables may include a fuel delivery rate, an airflow rate, a desired energy output rate, and/or another operational parameter.

According to an embodiment, an electric field controller may include a fuzzy logic circuit configured to determine a sequence of electric field modulation states in a combustion volume as a function of input variables and/or detected variables. The input variables may include a fuel delivery rate, an airflow rate, a desired energy output rate, and/or another operational parameter.

According to embodiments, related systems include but are not limited to circuitry and/or programming for providing method embodiments. Combinations of hardware, software, and/or firmware may be configured according to the preferences of the system designer.

DETAILED DESCRIPTION

Figure 1:
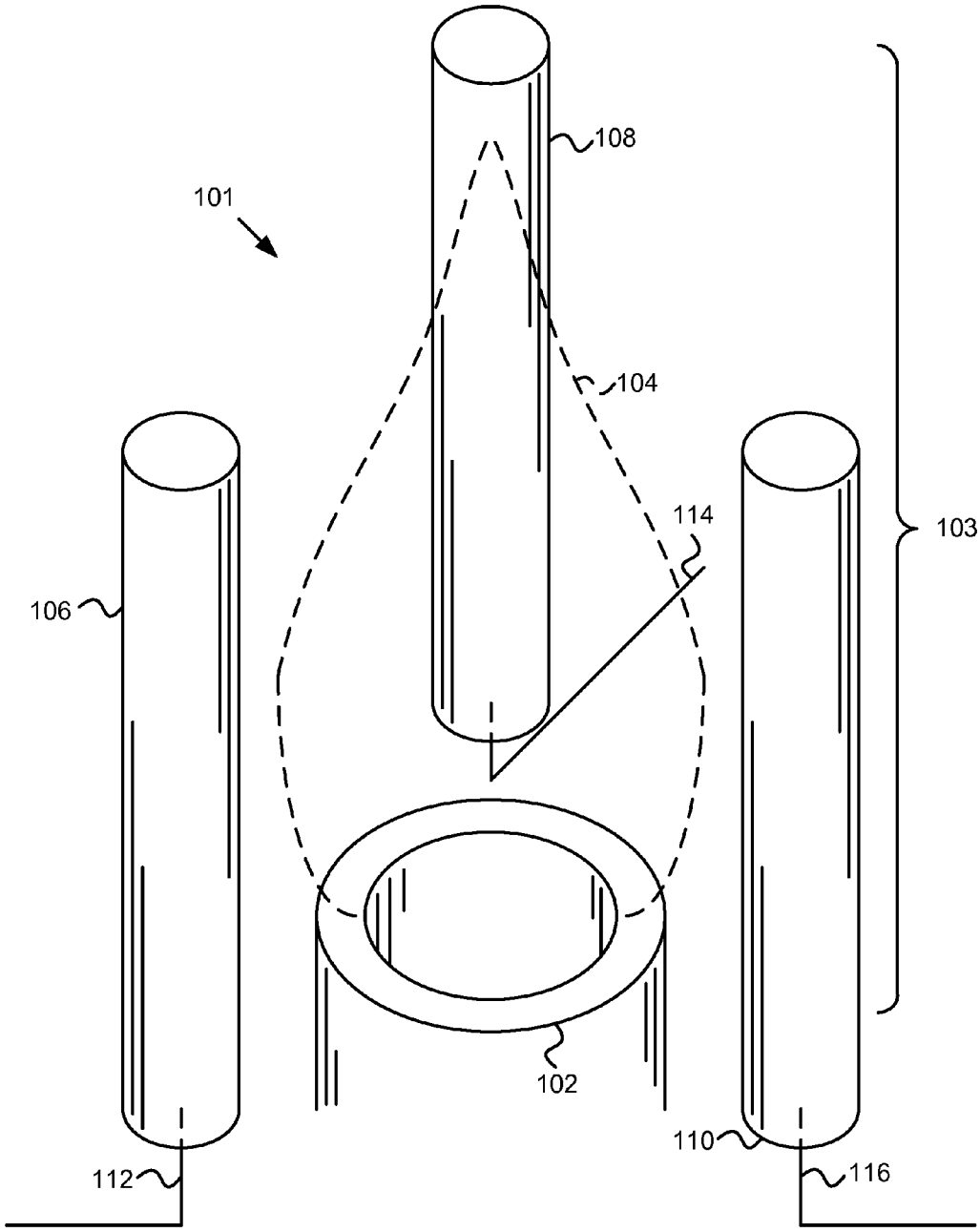
FIG. 1 is a diagram of a combustion volume configured for application of a time-varying electric field, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used and/or and other changes may be made without departing from the spirit or scope of the disclosure.

FIG. 1 is a diagram of a combustion volume 103 with a system 101 configured for application of a time-varying electric field to the combustion volume 103, according to an embodiment. A burner nozzle 102 is configured to support a flame 104 in a combustion volume 103. For example, the combustion volume 103 may form a portion of a boiler, such as a water tube boiler or a fire tube boiler, a hot water tank, a furnace, an oven, a flue, an exhaust pipe, a cook top, or the like.

At least three electrodes 106, 108, and 110 are arranged near or in the combustion volume 103 such that application of respective voltage signals to the electrodes may form an electric field across the combustion volume 103 in the vicinity of or through the flame 104 supported therein by the burner nozzle 102. According to an embodiment, the electrodes 106, 108, and 110 are positioned in radial symmetry around an axis defined by the burner nozzle 102. This can be seen, in particular, in the plan view of FIGS. 2A-2C. The electrodes 106, 108, and 110 may be respectively energized by corresponding leads 112, 114, and 116, which may receive voltage signals from a controller and/or amplifier (not shown).

While the burner nozzle 102 is shown as a simplified hollow cylinder, several alternative embodiments may be contemplated. While the burner 102 and the electrodes 106, 108, and 110 are shown in respective forms and geometric relationships, other geometric relationships and forms may be contemplated. For example, the electrodes 106, 108, 110 may have shapes other than cylindrical. According to some embodiments, the burner nozzle 102 may be energized to form one of the electrodes. According to some embodiments, a plurality of nozzles 102 may support a plurality of flames 104 in the combustion volume 103.

According to an embodiment, a first plurality of electrodes 106, 108, 110 may support a second plurality of electric field axes across the combustion volume 103 in the vicinity of or through at least one flame. According to the example 101, one electric field axis may be formed between electrodes 106 and 108. Another electric field axis may be formed between electrodes 108 and 110. Another electric field axis may be formed between electrodes 106 and 110.

The illustrative embodiment of FIG. 1 may vary considerably in scale, according to the applications. For example, in a relatively small system the inner diameter of the burner 102 may be about a centimeter, and the distance between electrodes 106, 108, 110 may be about 1.5 centimeters. In a somewhat larger system, for example, the inner diameter of the burner 102 may be about 1.75 inches and the distance between the electrodes may be about 3.25 inches. Other dimensions and ratios between burner size and electrode spacing are contemplated.

According to embodiments, an algorithm may provide a sequence of voltages to the electrodes 106, 108, 110. The algorithm may provide a substantially constant sequence of electric field states or may provide a variable sequence of electric field states, use a variable set of available electrodes, etc. While a range of algorithms are contemplated for providing a range of sequences of electric field states, a simple sequence of electric fields for the three illustrative electrodes 106, 108, 110 is shown in FIGS. 2A-2C.

Figure 2A:
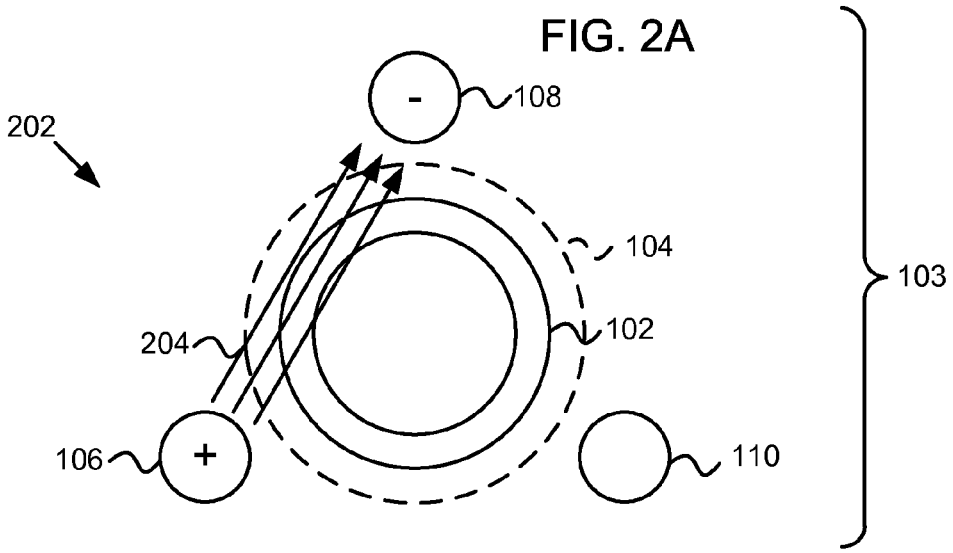
FIG. 2A is a depiction of an electric field in the combustion volume corresponding to FIG. 1 at a first time, according to an embodiment.
Figure 2B:
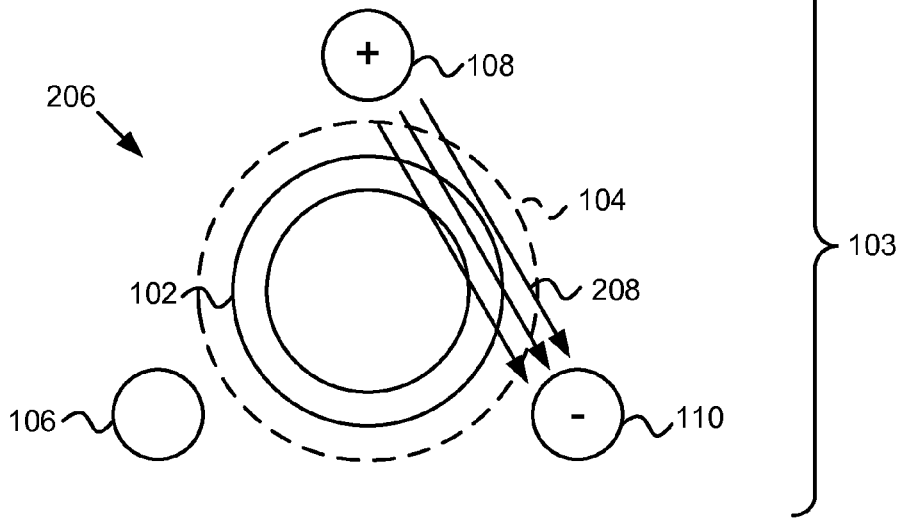
FIG. 2B is a depiction of an electric field in the combustion volume corresponding to FIG. 1 at a second time, according to an embodiment.
Figure 2C:
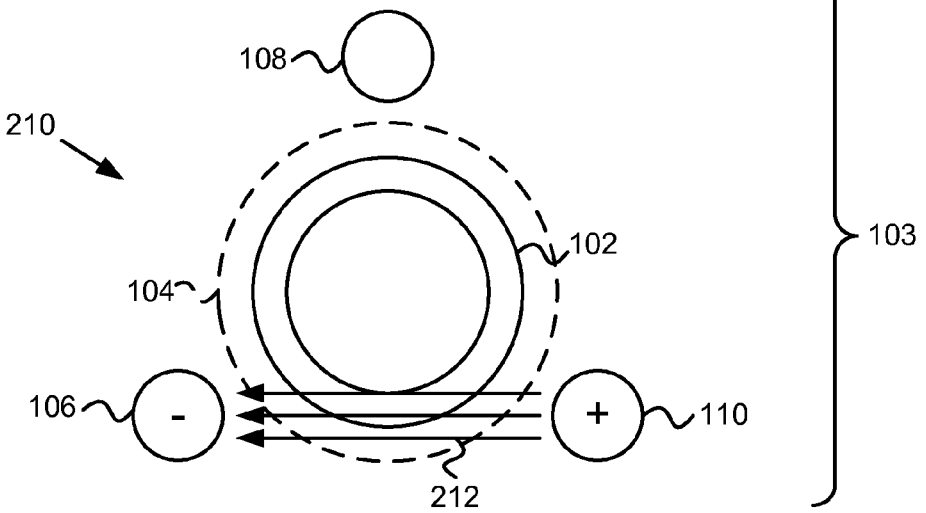
FIG. 2C is a depiction of an electric field in the combustion volume corresponding to FIG. 1 at a third time, according to an embodiment.

FIG. 2A is a depiction 202 of a nominal electric field 204 formed at least momentarily at a first time between an electrode 106 and an electrode 108, according to an embodiment. The electric field 204 is depicted such that electrode 106 is held at a positive potential and electrode 108 is held at a negative potential, such that electrons and other negatively charges species in the combustion volume 103 tend to stream away from electrode 108 and toward electrode 106. Similarly, positive ions and other positively charged species in the combustion volume 103 tend to stream away from electrode 106 and toward electrode 108.

A flame 104 in the combustion volume 103 may include a variety of charged and uncharged species. For example, charged species that may respond to an electric field may include electrons, protons, negatively charged ions, positively charged ions, negatively charged particulates, positively charged particulates, negatively charged fuel vapor, positively charged fuel vapor, negatively charged combustion products, and positively charged combustion products, etc. Such charged species may be present at various points and at various times in a combustion process. Additionally, a combustion volume 103 and/or flame may include uncharged combustion products, unburned fuel, and air. The charged species typically present in flames generally make flames highly conductive. Areas of the combustion volume 103 outside the flame 104 may be relatively non-conductive. Hence, in the presence of a flame 104, the nominal electric field 204 may be expressed as drawing negatively charged species within the flame 104 toward the volume of the flame proximate electrode 106, and as drawing positive species within the flame 104 toward the volume of the flame 104 proximate electrode 108.

Ignoring other effects, drawing positive species toward the portion of the flame 104 proximate electrode 108 may tend to increase the mass density of the flame 104 near electrode 108. It is also known that applying an electric field to a flame may increase the rate and completeness of combustion.

FIG. 2B is a depiction 206 of a nominal electric field 208 formed at least momentarily at a second time between electrode 108 and electrode 110, according to an embodiment. The electric field 208 is depicted such that electrode 108 is held at a positive potential and electrode 110 is held at a negative potential, such that negatively charged species in the combustion volume 103 tend to stream away from electrode 110 and toward electrode 108; and positive species in the combustion volume 103 tend to stream away from electrode 108 and toward electrode 110.

Similarly to the description of FIG. 2A, positive species in the flame 104 in the combustion volume 103 may be drawn toward the volume of the flame proximate electrode 110 and negatively charged species within the flame 204 may be drawn toward the volume of the flame proximate electrode 108. This may tend to increase the mass density of the flame 104 near electrodes 108 and/or 110.

If the electric field configuration 206 of FIG. 2B is applied shortly after application of the electric field configuration 202 of FIG. 2A, a movement of higher mass density positively charged species from the region of the flame 104 proximate electrode 108 to the region of the flame proximate electrode 110, may tend to cause a clockwise rotation of at least the positively charged species within the flame 104, along with an acceleration of combustion. If the relative abundance, relative mass, and/or relative drift velocity of positive species are greater than that of negative species, then application of the electric field configurations 202 and 206 in relatively quick succession may tend to cause a net rotation or swirl of the flame 104 in a clockwise direction. Alternatively, if the relative abundance, relative mass, and/or relative drift velocity of negative species are greater than that of positive species, then application of the electric field configurations 202 and 206 in relatively quick succession may tend to cause a net rotation or swirl of the flame 104 in a counter-clockwise direction.

FIG. 2C is a depiction 210 of an electric field 212 formed at least momentarily at a third time between electrode 110 and electrode 106, according to an embodiment. The electric field 212 is depicted such that electrode 110 is held at a positive potential and electrode 106 is held at a negative potential. In response, negatively charged species in the combustion volume 103 tend to stream away from electrode 110 and toward electrode 108; and positive species in the combustion volume 103 tend to stream away from electrode 108 and toward electrode 110.

Similarly to the description of FIGS. 2A and 2B, positive species in the flame 104 in the combustion volume 103 may be drawn toward the volume of the flame proximate electrode 106 and negatively charged species within the flame 204 may be drawn toward the volume of the flame proximate electrode 110. This may tend to increase the mass density of the flame 104 near electrode 106 and/or electrode 110, depending on the relative abundance, mass, and drift velocity of positively and negatively charged species. If the electric field configuration 210 of FIG. 2C is applied shortly after application of the electric field configuration 206 of FIG. 2B, a movement of higher mass density from the region of the flame 104 proximate electrode 110 to the region of the flame proximate electrode 106 may tend to cause a clockwise rotation of positive species and counter-clockwise rotation of negative species in the flame 104, along with an acceleration of combustion. Depending on the relative mass, relative abundance, and relative drift velocities of the positive and negative species, this may tend to cause a clockwise or counter-clockwise swirl.

According to an embodiment, for example when a field-reactive movement of species is dominated by positively charged species, a sequential, repeating application of nominal electric fields 204, 208, 212 may tend to accelerate the flame 104 to produce a clockwise swirl or vortex effect in the flame. Such a sequential electric field application may further tend to expose reactants to a streaming flow of complementary reactants and increase the probability of collisions between reactants to reduce diffusion-related limitations to reaction kinetics. Decreased diffusion limitations may tend to increase the rate of reaction, further increasing exothermic output, thus further increasing the rate of reaction. The higher temperature and higher reaction rate may tend to drive the flame reaction farther to completion to increase the relative proportion of carbon dioxide ($CO_2$) to other partial reaction products such as carbon monoxide (CO), unburned fuel, etc. exiting the combustion volume 103. The greater final extent of reaction may thus provide higher thermal output and/or reduce fuel consumption for a given thermal output.

According to another embodiment, a sequential repeating application of nominal electric fields 204, 208, 212 may tend to accelerate the flame 104 to produce a counter-clockwise swirl or vortex effect in the flame, for example when a field-reactive movement of species is dominated by negatively charged species.

Referring to the example of FIGS. 2A-2C, and in particular to the electric fields 204, 208, and 212, it can be seen that, as viewed from the burner 102, each field is oriented with an electrode on the left having a relatively higher, or more positive potential, and an electrode on the right having a relatively lower, or more negative potential. Accordingly, in each case, a positively-charged particle will tend to move to the right, while a negatively-charged particle will tend to move to the left. Thus, with respect to its influence on a charged particle, an electric field can be described or defined with respect to its handedness, depending upon the orientation of its polarity relative to the burner and the polarity of the charged particle. Furthermore, two electric fields can be defined as having a same handedness or an opposite handedness, depending on whether their respective polarities are oriented in the same direction or in opposite directions, as viewed from the burner. More specifically, referring to the fields 204, 208, and 212 of FIGS. 2A-2C, each field can be defined as being right-handed, with respect to a positively-charged particle or left-handed with respect to a negatively-charged particle, and any two or more of them can be defined as having a same handedness.

While the electrode configuration and electric field sequence shown in FIGS. 1 and 2A-2C is shown as an embodiment using a relatively simple configuration of three electrodes 106, 108, 110 and three electric field axes 204, 208, 212, other configurations may be preferable for some embodiments and some applications. For example an electric field may exist simultaneously between more than two electrodes. The number of electrodes may be increased significantly. The timing of electric field switching may be changed, may be made at a non-constant interval, may be made to variable potentials, may be informed by feedback control, etc. The electrode configuration may be altered significantly, such as by integration into the combustion chamber wall, placement behind the combustion chamber wall, etc. Furthermore, electrodes may be placed such that the electric field angle varies in more than one plane, such as by placing some electrodes proximal and other electrodes distal relative to the burner nozzle. In other embodiments, a given electrode may be limited to one state (such as either positive or negative) plus neutral. In other embodiments, all electrodes may be limited to one state (such as either positive or negative) plus neutral.

Figure 3:
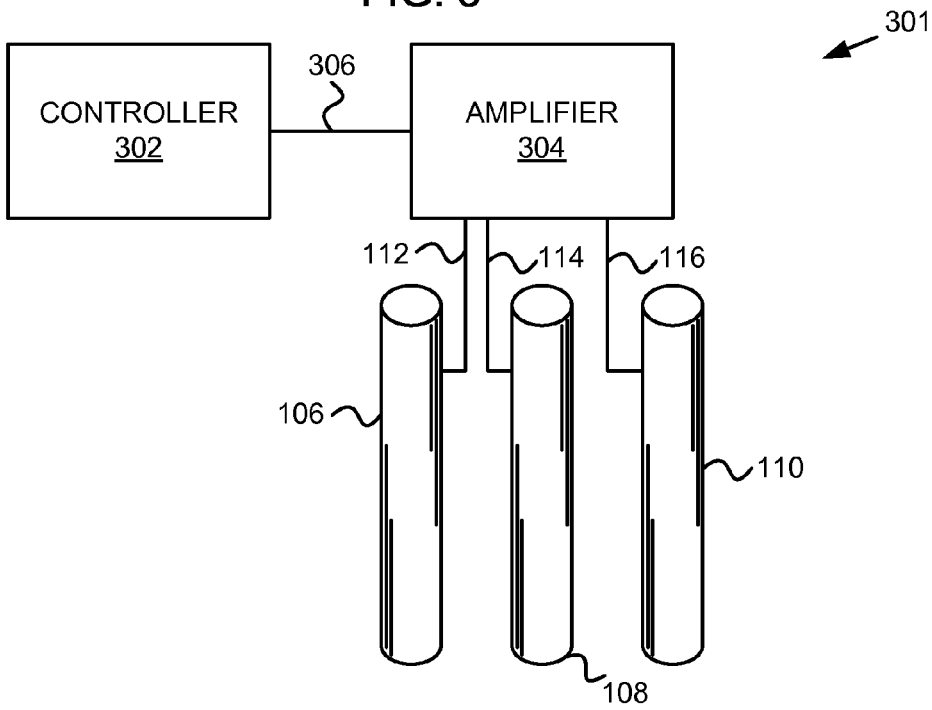
FIG. 3 is block diagram of a system configured to provide a time-varying electric field across a combustion volume, according to an embodiment.

FIG. 3 is block diagram of a system 301 configured to provide a time-varying electric field across a combustion volume, according to an embodiment. An electronic controller 302 is configured to produce a plurality of time-varying waveforms for driving a plurality of electrodes 106, 108 and 110. The waveforms may be formed at least partly by a sequencer (not shown) forming a portion of the controller 302. The sequencer may be formed from a software algorithm, a state machine, etc., operatively coupled to an output node 306. The waveforms are transmitted to an amplifier 304 via one or more signal lines 306. The amplifier 304 amplifies the waveforms to respective voltages for energizing the electrodes 106, 108, and 110 via the respective electrode leads 112, 114, and 116.

According to an embodiment, the waveforms may be produced by the controller 302 at a constant frequency. According to embodiments, the constant frequency may be fixed or selectable. According to another embodiment, the waveforms by be produced at a non-constant frequency. For example, a non-constant period or segment of a period may help to provide a spread-spectrum field sequence and may help to avoid resonance conditions or other interference problems.

According to an illustrative embodiment, electrode drive waveforms may be produced at about 1 KHz. According to another embodiment, electrode drive waveforms may be produced with a period corresponding to about 10 KHz. According to another embodiment, electrode drive waveforms may be produced at about 20 KHz. According to an illustrative embodiment, the amplifier 304 may drive the electrodes 106, 108, and 110 to about 900 volts. According to another embodiment, the amplifier 304 may drive the electrodes 106, 108, 110 to about +450 and −450 volts. As mentioned elsewhere, portions of a period may include opening a circuit to one or more electrodes 106, 108, 110 to let its voltage "float".

Figure 4:
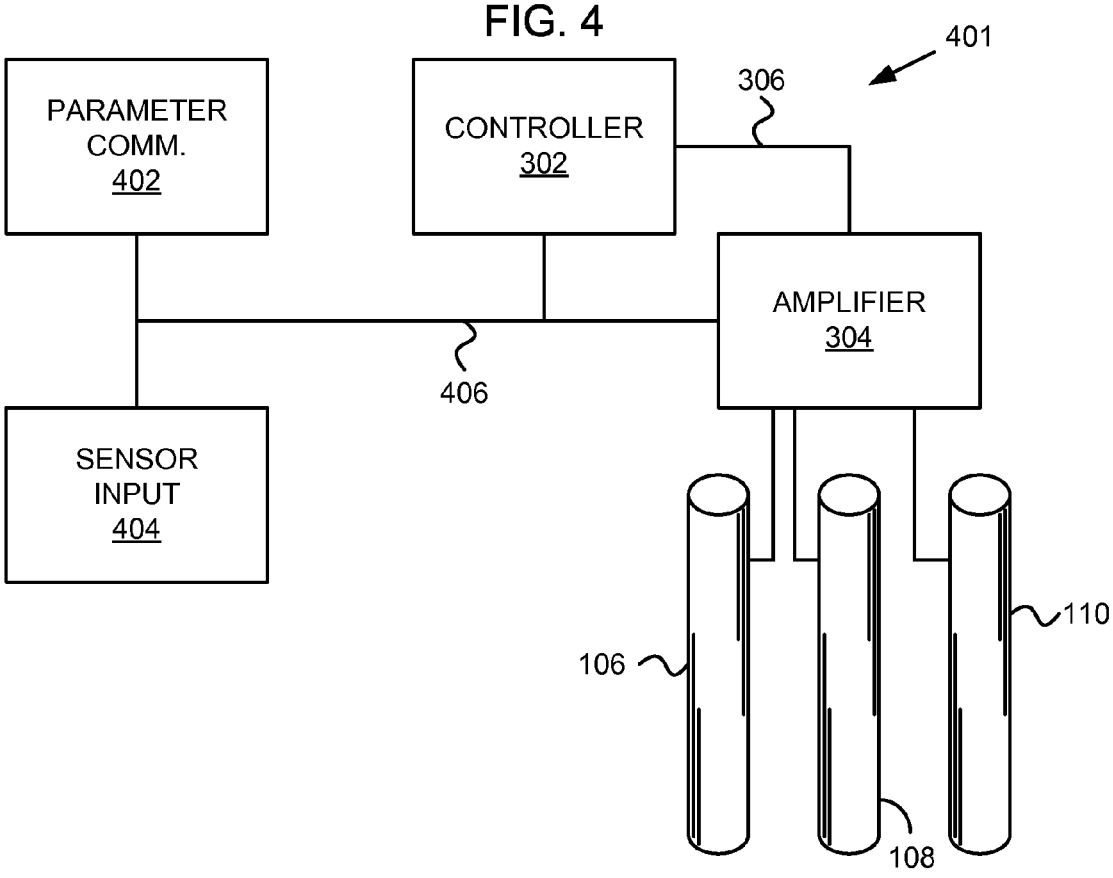
FIG. 4 is block diagram of a system configured to provide a time-varying electric field across a combustion volume, according to an embodiment.

According to some embodiments, it may be desirable to set or vary the electric field frequency and/or the voltage of the electrodes 106, 108, 110, and/or to provide sensor feedback such as a safety interlock or measurements of flame-related, electric field-related, or other parameters. FIG. 4 is block diagram of a system 401 configured to receive or transmit at least one combustion or electric field parameter and/or at least one sensor input. The system 401 may responsively provide a time-varying electric field between electrodes 106, 108, 110 across a combustion volume as a function of the at least one combustion parameter and/or at least one sensor input, according to another embodiment. For example, the modulation frequency of the electric field states and/or the electrode voltage may be varied as a function of a fuel delivery rate, a desired energy output rate, or other desired operational parameter.

The controller 302 may be operatively coupled to one or more of a parameter communication module 402 and a sensor input module 404, such as via a data communication bus 406. The parameter communication module 402 may provide a facility to update software, firmware, etc used by the controller 302. Such updates may include look-up table and/or algorithm updates such as may be determined by modeling, learned via previous system measurements, etc. The parameter communication module 402 may further be used to communicate substantially real time operating parameters to the controller 302. The parameter communication module 402 may further be used to communicate operating status, fault conditions, firmware or software version, sensor values, etc. from the controller 302 to external systems (not shown).

A sensor input module 404 may provide sensed values to the controller 302 via the data communication bus 406. Sensed values received from the sensor input module 404 may include parameters not sensed by external systems and therefore unavailable via the parameter communication module 402. Alternatively, sensed values received from the sensor input module 404 may include parameters that are also reported from external systems via the parameter communication module 402.

Parameters such as a fuel flow rate, stack gas temperature, stack gas optical density, combustion volume temperature, combustion volume luminosity, combustion volume ionization, ionization near one or more electrodes, combustion volume open, combustion volume maintenance lockout, electrical fault, etc. may be communicated to the controller 302 from the parameter communication module 402, sensor input module 404, and/or via feedback through the amplifier 304.

Voltage drive to the electrodes 106, 108, 110 may be shut off in the event of a safety condition state and/or a manual shut-down command received through the parameter communication module 402. Similarly, a fault state in the system 401 may be communicated to an external system to force a shutdown of fuel or otherwise enter a safe state.

The controller may determine waveforms for driving the electrodes 106, 108, 110 responsive to the received parameters, feedback, and sensed values (referred to collectively as "parameters"). For example the parameters may be optionally combined, compared, differentiated, integrated, etc. Parameters or combinations of parameters may be input to a control algorithm such as an algorithmic calculation, a table look-up, a proportional-integral-differential (PID) control algorithm, fuzzy logic, or other mechanisms to determine waveform parameters. The determined waveform parameters may include, for example, selection of electrodes 106, 108, 110, sequencing of electrodes 106, 108, 110, waveform frequency or period, electrode 106, 108, 110 voltage, etc.

The parameters may be determined, for example, according to optimization of a response variable such for maximizing thermal output from the combustion volume, maximizing an extent of reaction in the combustion volume, maximizing stack clarity from the combustion volume, minimizing pollutant output from the combustion volume, maximizing the temperature of the combustion volume, meeting a target temperature in the combustion volume, minimizing luminous output from a flame in the combustion volume, achieving a desired flicker in a flame in the combustion volume, maximizing luminous output from a flame in the combustion volume, maximizing fuel efficiency, maximizing power output, compensating for maintenance issues, maximizing system life, compensating for fuel variations, compensating for a fuel source, etc.

According to an embodiment, waveforms generated by the controller 302 may be transmitted to the amplifier 304 via one or more dedicated waveform transmission nodes 306. Alternatively, waveforms may be transmitted via the data bus 406. The amplifier 304 may provide status, synchronization, fault or other feedback via dedicated nodes 306 or may alternatively communicate status to the controller 302 and/or the parameter communication module 402 via the data bus 406.

While the controller 302 and amplifier 304 of FIGS. 3 and 4 are illustrated as discrete modules, they may be integrated. Similarly, the parameter communications module 402 and/or sensor input module 404 may be integrated with the controller 302 and/or amplifier 304.

Figure 5:
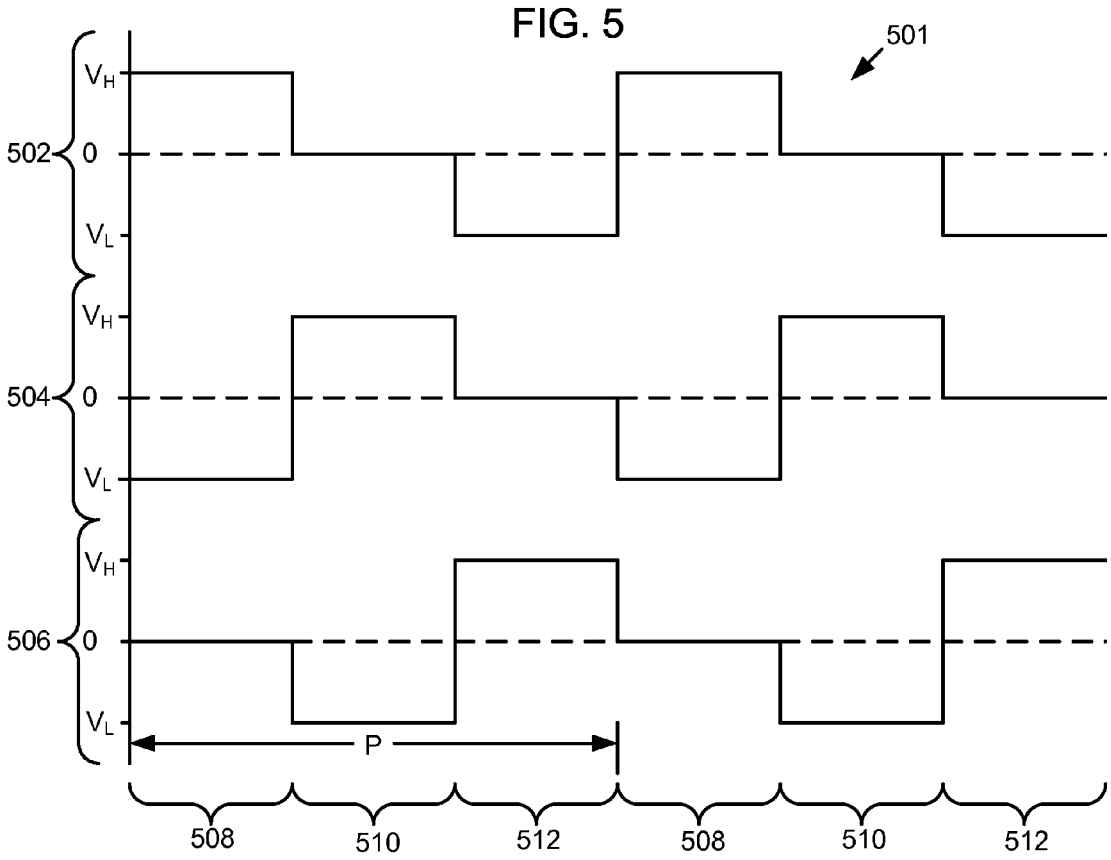
FIG. 5 is a timing diagram for controlling electrode modulation, according to an embodiment.

An illustrative set of waveforms is shown in FIG. 5, in the form of a timing diagram 501 showing waveforms 502, 504, 506 for respectively controlling electrode 106, 108, 110 modulation, according to an embodiment. Each of the waveforms 502, 504, and 506 are shown registered with one another along a horizontal axis indicative of time, each shown as varying between a high voltage, $V_H$, a ground state, 0, and a low voltage $V_L$. According to an embodiment, the waveforms 502, 504, 506 correspond respectively to energization patterns delivered to the electrodes 106, 108 and 110.

The voltages $V_H$, 0, and $V_L$ may represent relatively low voltages delivered to the amplifier 304 from the controller 302 via the amplifier drive line(s) 306. Similarly, the voltages $V_H$, 0, and $V_L$ may represent relatively large voltages delivered by the amplifier 304 to the respective electrodes 106, 108, 110 via the respective electrode drive lines 112, 114, 116. The waveforms 502, 504, 506 may be provided to repeat in a periodic pattern with a period P. During a first portion 508 of the period P, waveform 502 drives electrode 106 high while waveform 504 drives electrode 108 low, and waveform 506 drives electrode 110 to an intermediate voltage. Alternatively, portion 508 of waveform 506 (and corresponding intermediate states in the other waveforms 502, 504) may represent opening the electrode drive such that the electrode electrical potential floats.

Waveform portion 508 corresponds to the electric field state 202 shown in FIG. 2A. That is $V_H$ is applied to electrode 106 while $V_L$ is applied to electrode 108 to form an idealized electric field 204 between electrodes 106 and 108. Electrode 110 is either allowed to float or held at an intermediate potential such that reduced or substantially no electric fields are generated between it and the other electrodes.

During a second portion 510 of the period P, waveform 502 indicates that electrode 106 is held open to "float" or alternatively is driven to an intermediate voltage, while waveform 504 drives electrode 108 high to $V_H$ and waveform 506 drives electrode 110 to a low voltage $V_L$. Waveform portion 510 corresponds to the electric field state 206 shown in FIG. 2B. That is, $V_H$ is applied to electrode 108 while $V_L$ is applied to electrode 110 to form an idealized electric field 208 between electrodes 108 and 110. Electrode 106 is either allowed to float or held at an intermediate potential such that reduced or substantially no electric fields are generated between it and the other electrodes.

During a third portion 512 of the period P, waveform 504 indicates that electrode 108 is held open to "float" or alternatively is driven to an intermediate voltage, while waveform 506 drives electrode 110 high to $V_H$ and waveform 502 drives electrode 106 to a low voltage $V_L$. Waveform portion 512 corresponds to the electric field state 210 shown in FIG. 2B. That is, $V_H$ is applied to electrode 110 while $V_L$ is applied to electrode 106 to form an idealized electric field 212 between electrodes 110 and 106. Electrode 108 is either allowed to float or held at an intermediate potential such that reduced or substantially no electric fields are generated between it and the other electrodes. Proceeding to the next portion 508, the periodic pattern is repeated.

While the waveforms 502, 504, and 506 of timing diagram 501 indicate that each of the portions 508, 510, and 512 of the period P are substantially equal in duration, the periods may be varied somewhat or modulated such as to reduce resonance behavior, accommodate variations in combustion volume 103 geometry, etc. Additionally or alternatively, the periods P may be varied in duration. Similarly, while the voltage levels $V_H$, 0, and $V_L$ are shown as substantially equal to one another, they may also be varied from electrode-to-electrode, from period portion to period portion, and/or from period-to-period.

Returning to the waveforms 501 of FIG. 5, it may be seen that at a first point in time during the period portion 508, there is a potential difference and a corresponding electric field between an electrode corresponding to the waveform 502 and an electrode corresponding to the waveform 504. This is because the waveform 502 has driven a corresponding electrode to a relatively high potential and the waveform 504 has driven a corresponding electrode to a relatively low potential. Simultaneously, there is a reduced or substantially no electric field formed between an electrode corresponding to waveform 502 and an electrode corresponding to waveform 506, because waveform 506 has driven the potential of the corresponding electrode to an intermediate potential or has opened the circuit to let the electrode float. Similarly, at a second time corresponding to period portion 512, there is a potential difference and corresponding electric field between an electrode corresponding to the waveform 502 and an electrode corresponding to the waveform 506, but a reduced or substantially no potential difference or electric field between an electrode corresponding to the waveform 502 and an electrode corresponding to the waveform 504.

While the waveforms 502, 504, and 506 are shown as idealized square waves, the shape of the waveforms 502, 504, 506 may be varied. For example, leading and trailing edges may exhibit voltage overshoot or undershoot; leading and trailing edges may be transitioned less abruptly, such as by applying a substantially constant dl/dt circuit, optionally with acceleration; or the waveforms may be modified in other ways, such as by applying sine functions, etc.

Figure 6:
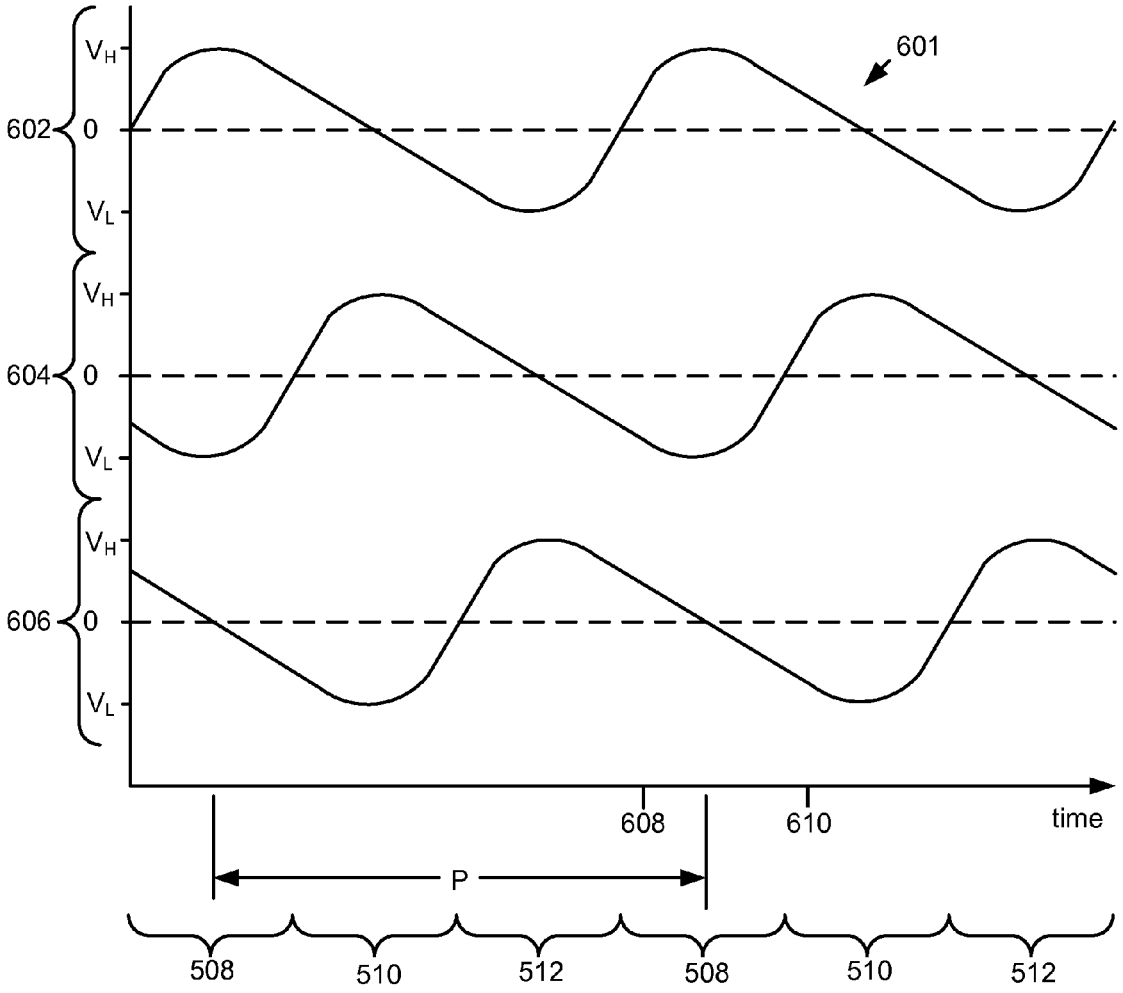
FIG. 6 is a diagram illustrating waveforms for controlling electrode modulation according to an embodiment.

FIG. 6 is a diagram 601 illustrating waveforms 602, 604, 606 for controlling electrode modulation according to another embodiment. The waveforms 602, 604, and 606 may, for example, be created from the corresponding waveforms 502, 504, 506 of FIG. 5 by driving the square waveforms through an R/C filter, such as driving through natural impedance. Alternatively, the waveforms 602, 604, and 606, may be digitally synthesized, driven by a harmonic sine-function generator, etc.

While the period portions 508, 510, and 512 may or may not correspond exactly to the corresponding portions of FIG. 5, they may be generally regarded as driving the electrodes 106, 108, and 110 to corresponding states as shown in FIGS. 2A-2C. The period P may be conveniently determined from a zero crossing as shown, or may be calculated to correspond to the position shown in FIG. 5.

As may be appreciated, when waveforms such as 602, 604, 606 drive corresponding electrodes 106, 108, 110; the idealized electric fields 204, 208, 212 of FIGS. 2A-2C may not represent the actual fields as closely as when waveforms such as 502, 504, 506 of FIG. 5 are used. For example, at the beginning of period portion 508 waveform 602 ramps up from an intermediate voltage, 0 to a high voltage $V_H$ while waveform 604 ramps down from an intermediate voltage, 0 to a low voltage $V_L$ and waveform 606 ramps down from a high voltage $V_H$ toward an intermediate voltage 0. Thus, the electric field 212 of FIG. 2C "fades" to the electric field 204 of FIG. 2A during the beginning of period portion 508. During the end of period portion 508, waveform 604 ramps up toward high voltage while waveform 606 continues to decrease and waveform 602 begins its descent from its maximum value. This may tend to fade electric field 204 toward the configuration 206, as a small reversed-sign field 212 appears, owing to the potential between electrodes 106 and 110.

Returning to the waveforms 601 of FIG. 6, it may be seen that at a first point in time 608, there are potential differences and corresponding electric fields between an electrode corresponding to the waveform 604 and respective electrodes corresponding to the waveforms 602 and 606. This is because the waveform 604 has driven a corresponding electrode to a relatively low potential and the waveforms 602 and 606 have driven corresponding electrodes to a relatively high potential. Simultaneously, there is substantially no electric field formed between an electrode corresponding to waveform 602 and an electrode corresponding to waveform 606, because waveforms 602 and 606 are momentarily at the same potential. Similarly, at a second point in time 610, there are potential differences and corresponding electric fields between an electrode corresponding to the waveform 606 and respective electrodes corresponding to the waveforms 602 and 604, but no potential difference or electric field between an electrode corresponding to the waveform 602 and an electrode corresponding to the waveform 604.

Figure 7:
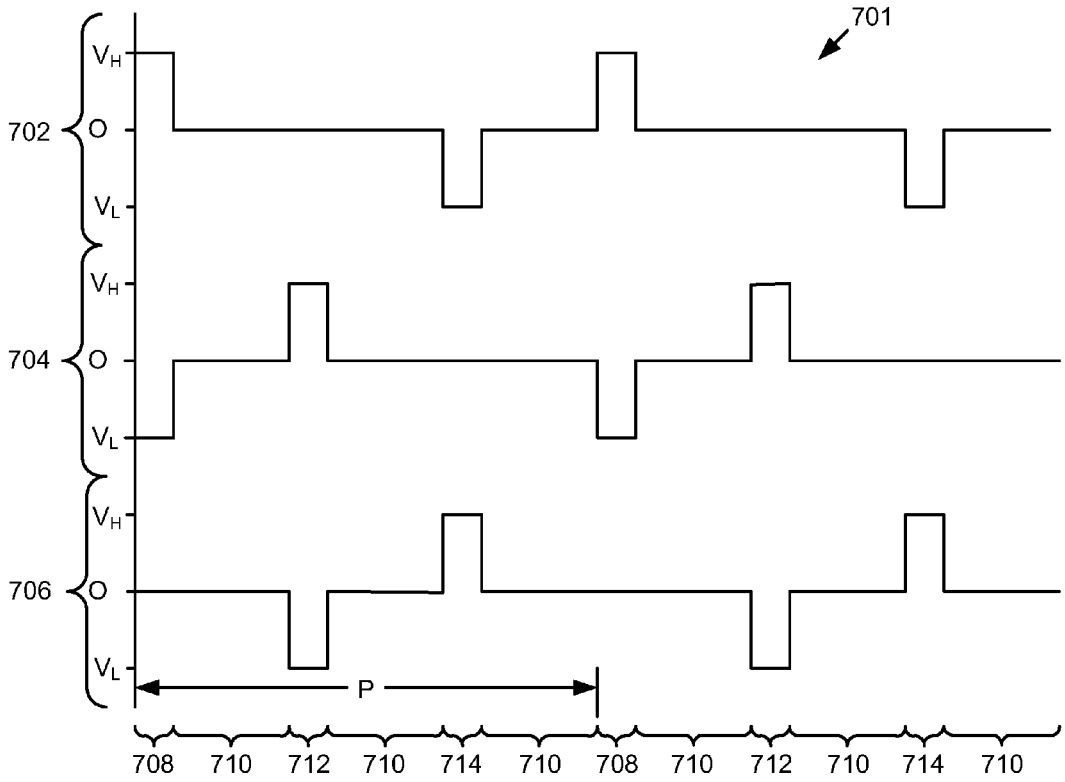
FIG. 7 is a diagram illustrating waveforms for controlling electrode modulation according to an embodiment.

FIG. 7 is a diagram 701 illustrating waveforms 702, 704, 706 for controlling modulation of the respective electrodes 106, 108, 110 according to another embodiment. Waveform 702 begins a period P during a portion 708 at a relatively high voltage $V_H$, corresponding to a relatively high voltage at electrode 106. Also during the portion 708, waveform 704 begins the period P at a relatively low voltage $V_L$, corresponding to a relatively low voltage at electrode 108; and waveform 706 corresponds to an open condition at electrode 110. Waveform portion 708 may be referred to as a first pulse period.

During the first pulse period 708, the electric field configuration in a driven combustion volume 103 may correspond to configuration 202, shown in FIG. 2A. As was described earlier, the nominal electric field 204 of configuration 202 may tend to attract positively charged species toward electrode 108 and attract negatively charged species toward electrode 106.

After the first pulse period 708, waveforms 702 and 704 drive respective electrodes 106 and 108 open while waveform 706 maintains the open circuit condition at electrode 110. During a portion 710 of the period P, the electrodes 106, 108, and 110 are held open and thus substantially no electric field is applied to the flame or the combustion volume. However, inertia imparted onto charged species during the preceding first pulse period 708 may remain during the non-pulse period 710, and the charged species may thus remain in motion. Such motion may be nominally along trajectories present at the end of the first pulse period 708, as modified by subsequent collisions and interactions with other particles.

At the conclusion of the first non-pulse portion 710 of the period P, a second pulse period 712 begins. During the second pulse period 712, waveform 702 provides an open electrical condition at electrode 106 while waveform 704 goes to a relatively high voltage to drive electrode 108 to a corresponding relatively high voltage and waveform 706 goes to a relatively low voltage to drive electrode 110 to a corresponding relatively low voltage. Thus during the second pulse period 712, an electric field configuration 206 of FIG. 2B occurs. This is again followed by a non-pulse portion of the waveforms 710, during which inertia effects may tend to maintain the speed and trajectory of charged species present at the end of the second pulse period 712, as modified by subsequent collisions and interactions with other particles.

At the conclusion of the second non-pulse portion 710, a third pulse period 714 begins, which may for example create an electric field configuration similar to electric field configuration 210, shown in FIG. 2C. After the third pulse period 714 ends, the system may again enter a non-pulse portion 710. This may continue over a plurality of periods, such as to provide a pseudo-steady state repetition of the period P portions 708, 710, 712, 710, 714, 710, etc.

According to one embodiment, the pulse periods and non-pulse portions may provide about a 25% duty cycle pulse train, as illustrated, wherein there is a field generated between two electrodes about 25% of the time and no applied electric fields the other 75% of the time. The duty cycle may be varied according to conditions within the combustion volume 103, such as may be determined by a feedback circuit and/or parameter input circuit as shown in FIGS. 3 and 4.

According to another embodiment, the pulse periods 708, 712, and 714 may each be about 10 microseconds duration and the period P may be about 1 KHz frequency, equivalent to 1 millisecond period. Thus, the non-pulse portions may each be about 323.333 microseconds.

The relative charge-to-mass ratio of a particular charged species may affect its response to the intermittent pulse periods 708, 712, 714 and intervening non-pulse portions 710. The duty cycle may be varied to achieve a desired movement of one or more charged species in the combustion volume 103. According to an embodiment, waveforms 702, 704, 706 optimized to transport a positively charged species clockwise may be superimposed over other waveforms (not shown) optimized to transport another positively charged species or a negatively charged species clockwise or counterclockwise to produce a third set of waveforms (not shown) that achieve transport of differing species in desired respective paths.

For example, a heavy, positive species may require a relatively high, 50% duty cycle with a relatively long period to move along a chosen path. A light, negative species may require a relatively low duty cycle with a relatively short period to move along a chosen path. The two waveforms may be superimposed to drive the positive and negative species in parallel (clockwise or counter-clockwise) or anti-parallel (clockwise and counter-clockwise) to each other.

While the electrodes 106, 108, 110 are shown arranged in figures above such that a straight line connecting any two electrodes passes through the volume of an intervening flame, other arrangements may be within the scope. While the number of electrodes 106, 108, 110 shown in the embodiments above is three, other numbers greater than three may similarly fall within the scope. While the electrodes 106, 108, 110 are indicated as cylindrical conductors arranged parallel to the major axis of the burner nozzle, other arrangements may fall within the scope.

For example, in another embodiment, a plurality of electrodes are arranged substantially at the corners of a cube, and include plates of finite size having normal axes that intersect at the center of the cube, which corresponds to the supported flame 104. In other embodiments (not shown) the electrodes may include surfaces or figurative points arranged at the centers of the faces of a cube, at the corners or at the centers of the faces of a geodesic sphere, etc.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method, comprising:

forming a first electric field between a first electrode and a second electrode in a combustion volume at a first modulation time by applying a first voltage to the first electrode and a second voltage to the second electrode; and forming a second electric field between the first electrode and a third electrode in the combustion volume at a second modulation time while there is a reduced or substantially no electric field formed between the first electrode and the second electrode by applying the first voltage to the third electrode, the second voltage to the first electrode, and causing the second electrode to be at an intermediate voltage;

wherein the first voltage is a peak positive voltage and the second voltage is a peak negative voltage.

2. The method of claim 1, comprising periodically repeating the forming a first electric field and the forming a second electric field, with a period that is substantially constant.

3. The method of claim 1, further comprising forming a third electric field between the second electrode and the third electrode in the combustion volume at a third modulation time while there is a reduced or substantially no electric field formed between either the first electrode and the second electrode or between the first electrode and the third electrode by applying the first voltage to the third electrode, the second voltage to the first electrode, and causing the second electrode to be at neither the first voltage nor the second voltage.

4. The method of claim 1, comprising periodically repeating the forming a first electric field and the forming a second electric field, with a period that is 200 microseconds or less.

5. The method of claim 4 comprising periodically repeating the forming a first electric field and the forming a second electric field, with a period that is 70 microseconds or less.

6. The method of claim 1, comprising periodically repeating the forming a first electric field and the forming a second electric field.

7. The method of claim 6, comprising periodically repeating the forming a first electric field and the forming a second electric field, with a period that is selected according to at least one selected from the group consisting of maximizing thermal output from the combustion volume, maximizing an extent of reaction in the combustion volume, maximizing stack clarity from the combustion volume, minimizing pollutant output from the combustion volume, maximizing the temperature of the combustion volume, meeting a target temperature in the combustion volume, minimizing luminous output from a flame in the combustion volume, achieving a desired flicker in a flame in the combustion volume, maximizing luminous output from a flame in the combustion volume, maximizing fuel efficiency, maximizing power output, compensating for maintenance issues, maximizing system life, compensating for fuel variations, compensating for a fuel source, minimizing resonance behavior, and accommodating variations in combustion volume geometry.

8. The method of claim 6, wherein the strengths of the at least one first electric field and the at least one second electric field are selected according to at least one selected from the group consisting of maximizing thermal output from the combustion volume, maximizing an extent of reaction in the combustion volume, maximizing stack clarity from the combustion volume, minimizing pollutant output from the combustion volume, maximizing the temperature of the combustion volume, meeting a target temperature in the combustion volume, minimizing luminous output from a flame in the combustion volume, achieving a desired flicker in a flame in the combustion volume, maximizing luminous output from a flame in the combustion volume, maximizing fuel efficiency, maximizing power output, compensating for maintenance issues, maximizing system life, compensating for fuel variations, compensating for a fuel source, minimizing resonance behavior, and accommodating variations in combustion volume geometry.

9. The method of claim 6, further comprising calculating at least one of a period and an electric field strength from at least two input parameters using at least one selected from the group consisting of combining input parameters, comparing input parameters, differentiating input parameters, integrating input parameters, performing an algorithmic calculation, performing a table look-up, performing a proportional-integral-differential (PID) control algorithm, and performing fuzzy logic.

10. A combustion system, comprising:

a plurality of electrodes arranged in radial symmetry around an axis defined by a burner;

a controller configured, at a first moment of a periodic cycle, to apply a maximum voltage to a first one of the plurality of electrodes, a minimum voltage to a second one of the plurality of electrodes, and to cause a third one of the plurality of electrodes to be at neither the maximum voltage nor the minimum voltage.

11. The combustion system of claim 10 wherein the controller is configured, during the first moment of the periodic cycle, to cause the third one of the plurality of electrodes to float, with respect to the first and second ones of the plurality of electrodes.

12. The combustion system of claim 10 wherein the controller is configured, during the first moment of the periodic cycle, to apply an intermediate voltage to the third one of the plurality of electrodes.

13. The combustion system of claim 12 wherein the maximum voltage is a positive voltage, the minimum voltage is a negative voltage, and the intermediate voltage is a value corresponding to a ground potential.

14. The combustion system of claim 10 wherein the controller is configured, at a second moment of the periodic cycle, to apply the maximum voltage to the second one of the plurality of electrodes, the minimum voltage to the third one of the plurality of electrodes, and to cause the first one of the plurality of electrodes to be at neither the maximum voltage nor the minimum voltage.

15. The combustion system of claim 14 wherein the controller is configured, at a third moment of the periodic cycle, to apply the maximum voltage to the third one of the plurality of electrodes, the minimum voltage to the first one of the plurality of electrodes, and to cause the second one of the plurality of electrodes to be at neither the maximum voltage nor the minimum voltage.

* * * * *